US008602676B2

(12) United States Patent
Stollery

(10) Patent No.: US 8,602,676 B2
(45) Date of Patent: Dec. 10, 2013

(54) COMPACT QUICK COUPLING MECHANISM FOR TOOL ATTACHMENT

(75) Inventor: Randal D. Stollery, Edmonton (CA)

(73) Assignee: Brandt Industries Ltd., Regina SK (CA)

( * ) Notice: Subject to any disclaimer, the term of this patent is extended or adjusted under 35 U.S.C. 154(b) by 52 days.

(21) Appl. No.: 13/419,982

(22) Filed: Mar. 14, 2012

(65) Prior Publication Data

US 2012/0237283 A1 Sep. 20, 2012

(30) Foreign Application Priority Data

Mar. 14, 2011 (CA) ..... 2733965

(51) Int. Cl.
*E02F 3/96* (2006.01)

(52) U.S. Cl.
USPC ..... 403/322.1; 403/325; 403/327

(58) Field of Classification Search
USPC ..... 403/321, 322.1, 325, 326, 327; 37/413, 37/443, 444, 468; 414/723; 172/272–275
See application file for complete search history.

(56) References Cited

U.S. PATENT DOCUMENTS

| | | | | | |
|---|---|---|---|---|---|
| 2,963,183 | A * | 12/1960 | Przybylski | 414/723 |
| 3,556,323 | A * | 1/1971 | Heimmermann et al. | 414/723 |
| 5,107,610 | A * | 4/1992 | Fusco | 37/444 |
| 5,467,542 | A * | 11/1995 | Hulden | 37/468 |
| 5,597,283 | A * | 1/1997 | Jones | 414/723 |
| 5,890,871 | A * | 4/1999 | Woerman | 414/723 |
| 5,915,837 | A * | 6/1999 | Brown et al. | 37/468 |
| 6,139,212 | A * | 10/2000 | Heiple | 403/322.1 |
| 6,231,296 | B1 * | 5/2001 | Blomgren | 414/723 |
| 6,254,331 | B1 * | 7/2001 | Pisco et al. | 414/723 |
| RE37,339 | E * | 8/2001 | Horton | 37/468 |
| 6,305,106 | B1 * | 10/2001 | McLellan | 37/468 |
| 6,379,075 | B1 * | 4/2002 | Shamblin et al. | 403/322.1 |
| 6,487,800 | B1 * | 12/2002 | Evans et al. | 37/468 |
| 6,709,224 | B2 * | 3/2004 | Heiple | 414/723 |
| 7,654,019 | B2 * | 2/2010 | Yeager et al. | 37/468 |
| 8,403,590 | B2 * | 3/2013 | Hill | 403/322.3 |
| 2006/0037220 | A1 * | 2/2006 | Cunningham et al. | 37/468 |
| 2007/0166143 | A1 * | 7/2007 | Hart et al. | 414/723 |

* cited by examiner

*Primary Examiner* — Michael P Ferguson
*Assistant Examiner* — Matthieu Setliff
(74) *Attorney, Agent, or Firm* — Frost Brown Todd LLC

(57) ABSTRACT

A compact quick coupling apparatus has a wedge movable between closed and open positions. A wedge spring extends in the opening direction from the wedge and urges the wedge in the closing direction. A latch spring urges a safety latch to a latched position to prevent the wedge from moving. A single acting hydraulic cylinder extends through the wedge and extends in the opening direction from the wedge. As the hydraulic cylinder extends it first moves the safety latch to the unlatched position, and then moves the wedge in the opening direction. When pressurized fluid is released from the hydraulic cylinder, it retracts and the wedge moves in the closing in response to the wedge spring until the wedge reaches the closed position, and then the hydraulic cylinder further retracts in response to the latch spring and the safety latch moves to the latched position.

10 Claims, 8 Drawing Sheets

COMPACT QUICK COUPLING MECHANISM FOR TOOL ATTACHMENT

This application claims priority to Canadian Patent Application Serial No. 2,733,965, filed on Mar. 14, 2011, entitled "Compact Quick Coupling Mechanism For Tool Attachment," the disclosure of which is hereby incorporated by reference.

This invention is in the field of machines such as hoe excavators and in particular a compact mechanism for coupling and uncoupling a tool particularly to smaller versions of such machines, for example for coupling an excavator bucket to the excavator hoe atm of a mini-excavator.

BACKGROUND

In many types of machines different tools are coupled to and then uncoupled from the machine to accomplish different tasks. For example, a hoe excavator with a hoe arm may have a variety of buckets of various widths and shapes that are suitable for particular different tasks. Depending on the task, the desired bucket is coupled to the end of the hoe arm of the excavator, and when that task is finished the bucket will be uncoupled and a different bucket will be coupled to the arm to accomplish the next task. In addition to various buckets, other tools such as pneumatic hammers, post hole augers, and the like are often attached to the excavator arm to increase the variety of tasks that the machine may accomplish.

Changing the bucket can be time consuming and so various quick coupling mechanisms have been developed to reduce the time and effort required to couple various tools to the excavator arm. Often these tools are maneuvered in holes or like confined areas where people are working, and so it is necessary for such quick coupling mechanisms to secure the tool such that the tool cannot fall off accidentally, and further must secure the tool tightly to the end of the excavator arm such that undesirable loose movement of the tool with respect to the excavator arm is prevented and control is maintained.

U.S. Pat. No. 6,487,800 to Evans et al. discloses a quick coupler with a coupling bar that is moved by rotating threaded bolts to a closed and coupled position to secure the engagement of the end of an excavator arm to a tool, such as a bucket. U.S. Pat. Nos. 5,890,871 to Woerman and 7,654,019 to Yeager et al. disclose quick coupler mechanism where a spring exerts a bias force on a wedge shaped bar towards a closed position where the bar is engaged in a groove to lock the tool to the arm. When pressurized fluid is directed into a single acting hydraulic cylinder, the cylinder exerts a force against the bias force of the spring to move the bar to the open position where the bar is disengaged from the groove. When the pressurized fluid is released from the cylinder, the bias force collapses the cylinder and moves the bar to the closed position. Thus if the hydraulic cylinder fails, the bar stays closed, engaging the tool and arm so the tool does not fall off.

The present quick coupler mechanisms are designed for conventional large excavators and the like. More recently very much smaller versions of these machines, commonly referred to as mini-excavators, have become popular and scaling down the existing quick couplers for use on these mini excavators has been problematic. In the coupler mechanisms of Woerman and Yeager, the hydraulic cylinder extends from the bar towards the closed position, and thus inside the coupler mechanism. This arrangement works well where there is considerable room, as in conventional large excavators and the like, but is problematic where the mechanism is scaled down for a mini excavator.

SUMMARY OF THE INVENTION

It is an object of the present invention to provide a compact quick coupling apparatus for coupling a tool to a machine that overcomes problems in the prior art.

The present invention provides a compact quick coupling apparatus for coupling a tool to a tool arm of a tool manipulating machine. The apparatus comprises a coupler member adapted to be attached to the tool arm, and configured to engage a mounting bracket extending out from the tool. A wedge is mounted on the coupler member and is movable, when the coupler member and mounting bracket are engaged, from a closed position where the wedge is engaged in a groove on the mounting bracket and where a tapered side of the wedge bears against a corresponding tapered side of the groove to draw the coupler member into engagement with the mounting bracket, to an open position where the wedge is removed from the groove. The wedge moves in an opening direction when moving from the closed position to the open position, and moves in a closing direction when moving from the open position to the closed position. A wedge bias element extends in the opening direction from the wedge, the wedge bias element operative to continuously exert a wedge bias force on the wedge in the closing direction to push the wedge into the groove, and operative to exert the wedge bias force on the wedge when the wedge is in the closed position such that the wedge bias force maintains the wedge in the closed position. A latch bias element is operative to exert a latch bias force urging a safety latch to a latched position, and the safety latch is configured such that when the wedge moves into the groove and reaches the closed position, the safety latch can move from an unlatched position to the latched position to prevent the wedge from moving in the opening direction. A single acting hydraulic cylinder extends through the wedge and extends in the opening direction from the wedge, and the hydraulic cylinder is configured such that when pressurized fluid is directed into the hydraulic cylinder, the hydraulic cylinder extends and the hydraulic cylinder first contacts the safety latch and exerts a force moving the safety latch to the unlatched position, and when the safety latch is in the unlatched position, further extension of the hydraulic cylinder causes the hydraulic cylinder to exert a force on the wedge in the opening direction substantially opposite to the wedge bias force to move the wedge toward the open position. The single acting hydraulic cylinder is configured such that when pressurized fluid is released from the hydraulic cylinder, the hydraulic cylinder retracts and the wedge moves in the closing direction and into the groove in response to the wedge bias force until the wedge reaches the closed position, and then the hydraulic cylinder further retracts in response to the latch bias force and the safety latch moves to the latched position. A remotely operated control is operative to selectively direct pressurized fluid into the hydraulic cylinder and release pressurized fluid from the hydraulic cylinder.

In the prior art opening and latching mechanisms, the hydraulic cylinder and/or spring biasing elements are located toward the inside of the mechanism, in the direction the wedge moves when it is closing. This area is between the pin that connects the coupler member on the tool arm to the mounting bracket on the bucket, and the wedge. The area becomes quite crowded when the mechanism is scaled down for a mini excavator or the like. The present invention therefore provides a mechanism where both the hydraulic cylinder and spring biasing elements are located toward the outside of the mechanism, in the direction the wedge moves when it is opening.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
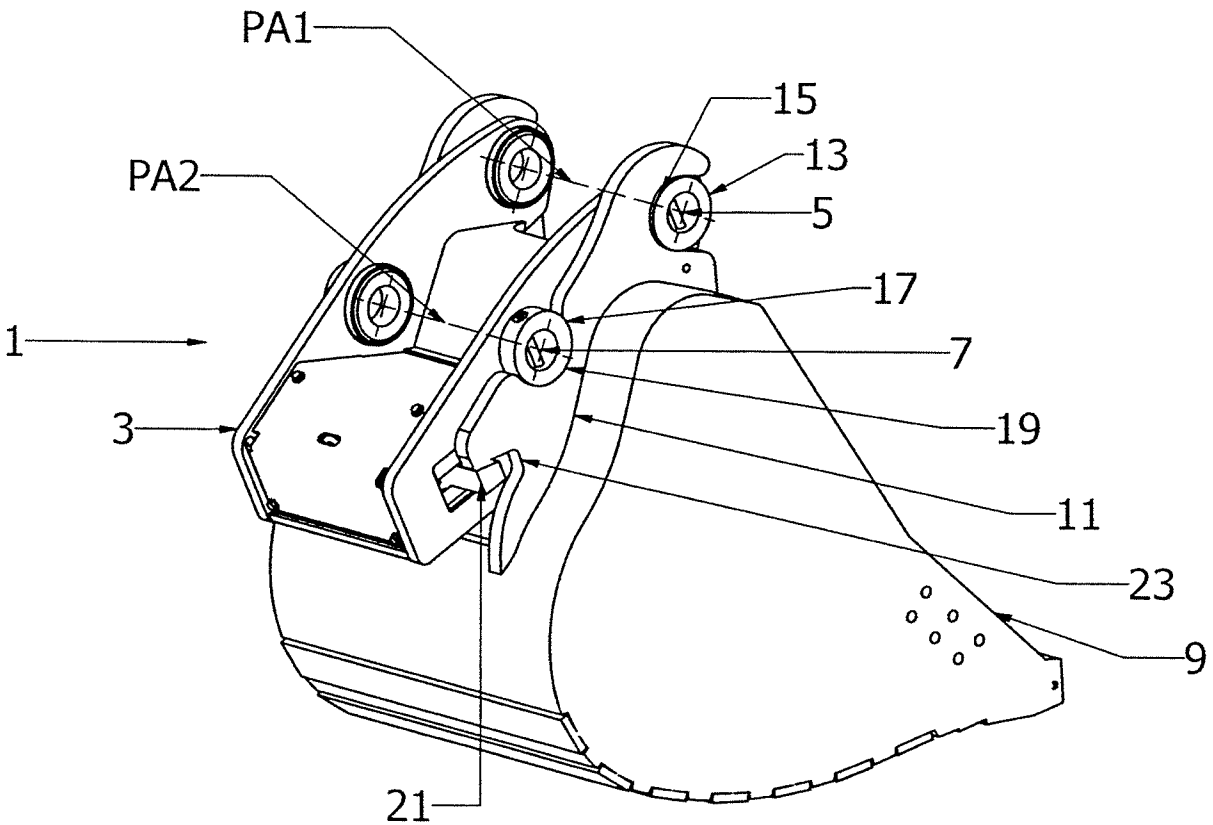
FIG. 1 is a perspective view of an embodiment of the quick coupling apparatus of the present invention connected to an excavator bucket.
Figure 2:
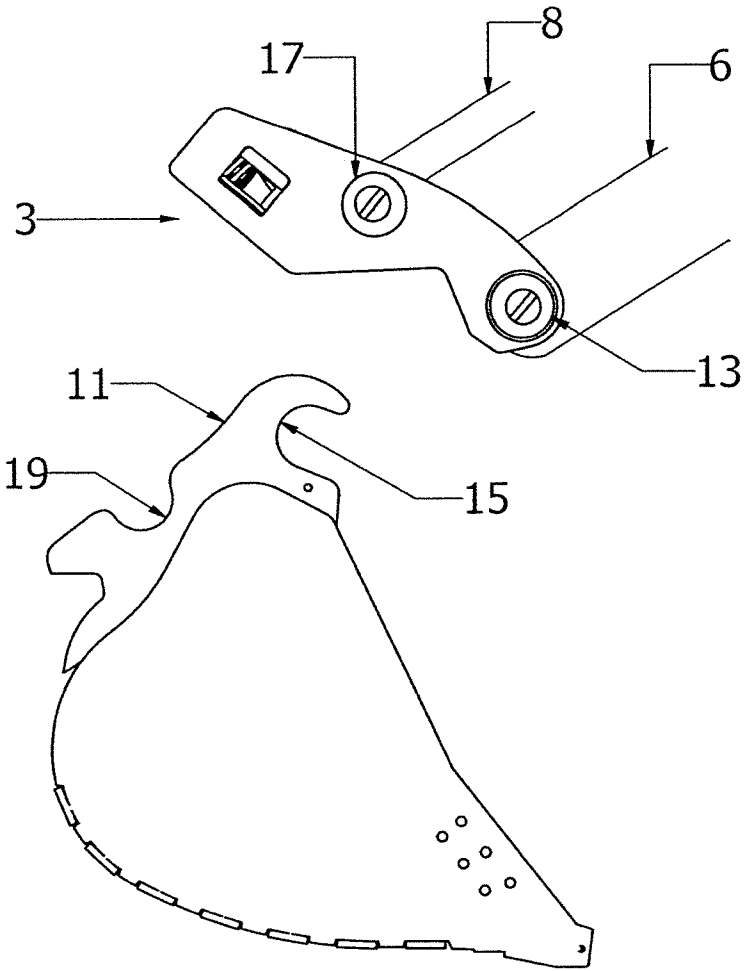
FIGS. 2-5 are side views showing the steps for installing the apparatus of FIG. 1 to the bucket.

FIGS. 1-5 illustrate the operation of an embodiment of a quick coupling apparatus 1 of the present invention. The apparatus 1 comprises a coupler member 3 that is attached to a tool manipulating machine at the tool attachment point. The illustrated apparatus 1 is adapted for attachment to the end of the hoe arm of an excavator. The attachment is conventional, and the hoe arm is not illustrated. The coupler member 3 is attached by a first pin through first pin aperture 5 and through a corresponding aperture on the end of the hoe arm 6, and then by a second parallel pin through second pin aperture 7 and through a corresponding aperture on the end of the hydraulic tool cylinder 8 that extends and retracts to pivot the apparatus 1 about the end of the hoe arm.

Figure 3:
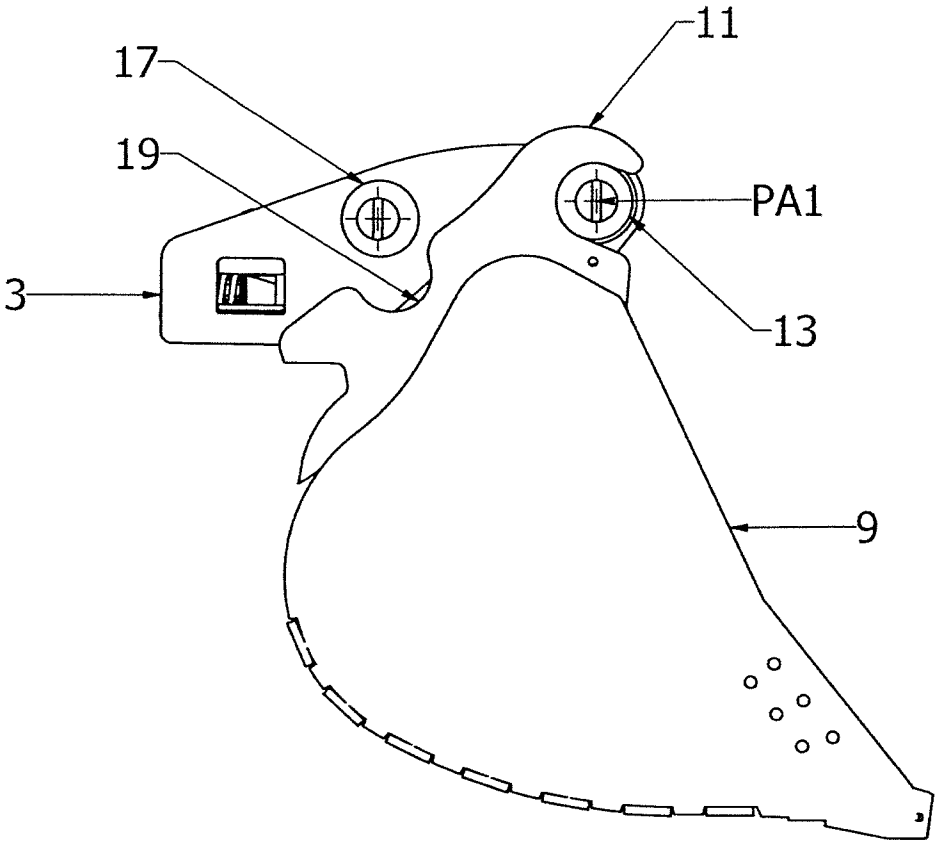

The coupler member 3 is configured to engage mounting brackets 11 that extend out from the bucket 9. A first set of lugs 13 on the coupler member 3 are manipulated from the unattached position of FIG. 2 into engagement with a corresponding first set of recesses 15 on the mounting brackets 11 as illustrated in FIG. 3, and then the hydraulic tool cylinder is operated to pivot the coupler member 3 about the pivot axis PA1 created by the first lugs 13 engaging the first recesses 15 such that a second set of lugs 17 on the coupler member 3 engage a second set of recesses 19 on the mounting bracket 3 as illustrated in FIG. 4.

The coupler member 3 and mounting brackets 11 are configured such that when the first and second sets of lugs 13, 17 are in full engagement with the corresponding first and second sets of recesses 15, 19 the bucket 9 is properly oriented with respect to the hoe arm, as illustrated in FIG. 1.

Figure 4:
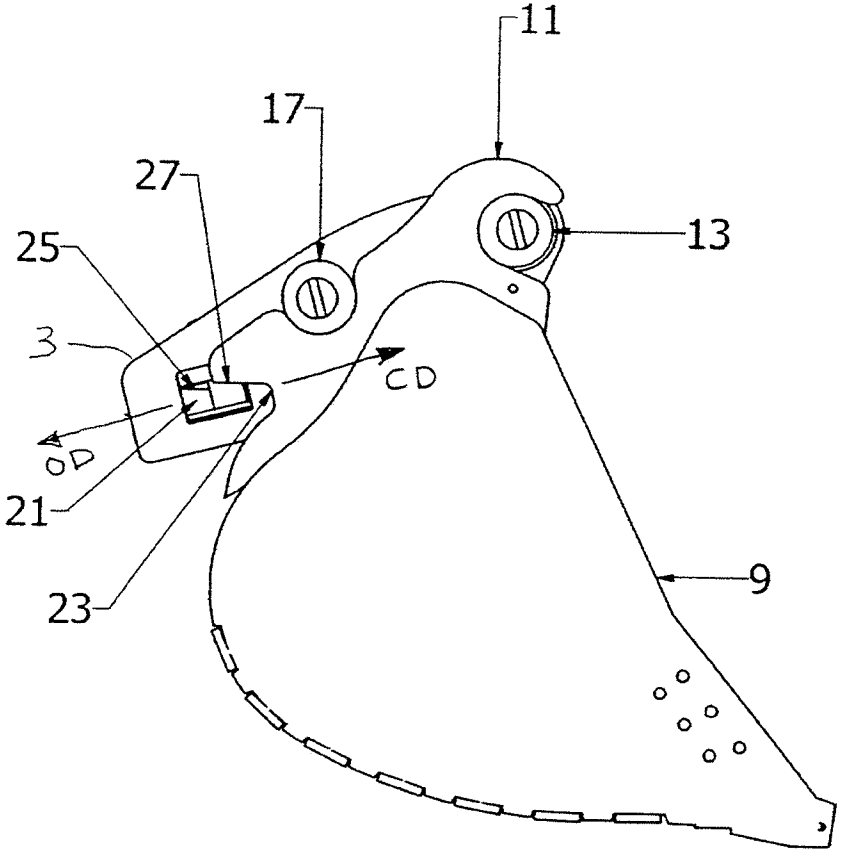
Figure 5:
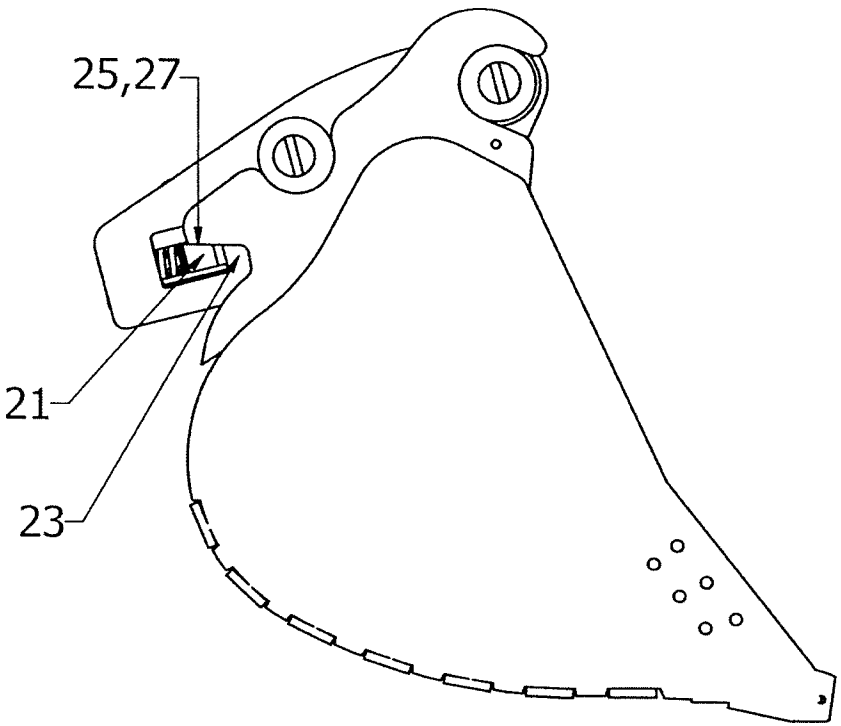
Figure 6:
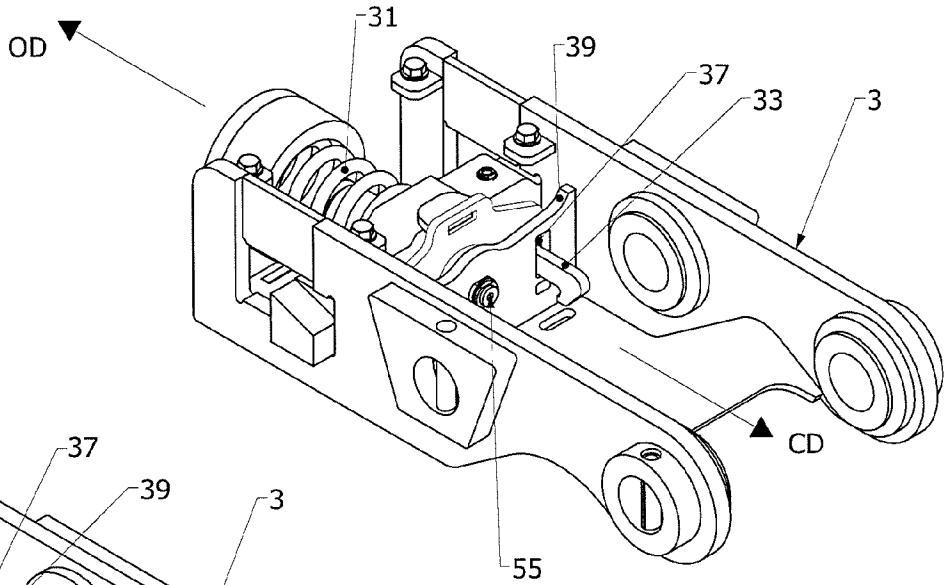
FIG. 6 is a perspective view of the latching and wedge positioning mechanism in the apparatus of FIG. 1 with the single acting hydraulic cylinder in the fully retracted position and the latch arms in the latched position.
Figure 7:
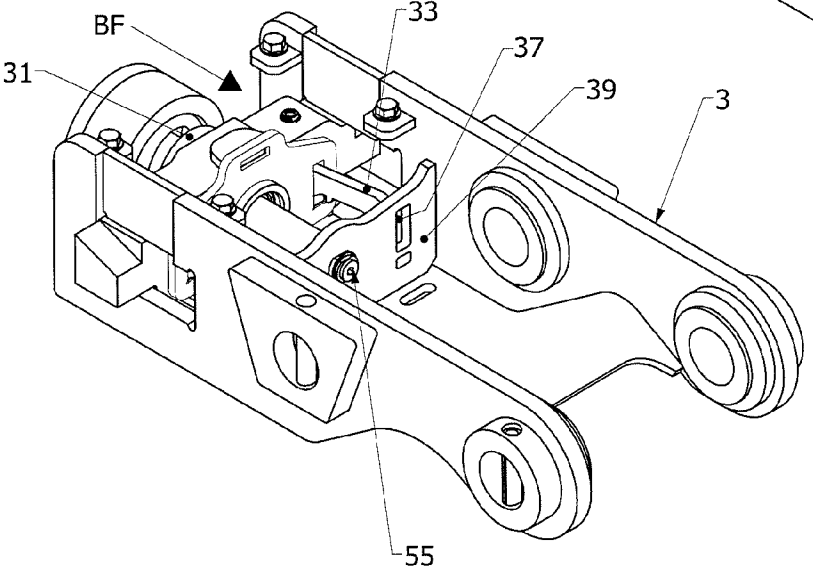
FIG. 7 is a perspective view of the latching and wedge positioning mechanism of FIG. 6 with the single acting hydraulic cylinder in the fully extended position and the latch arms in the raised unlatched position.
Figure 8:
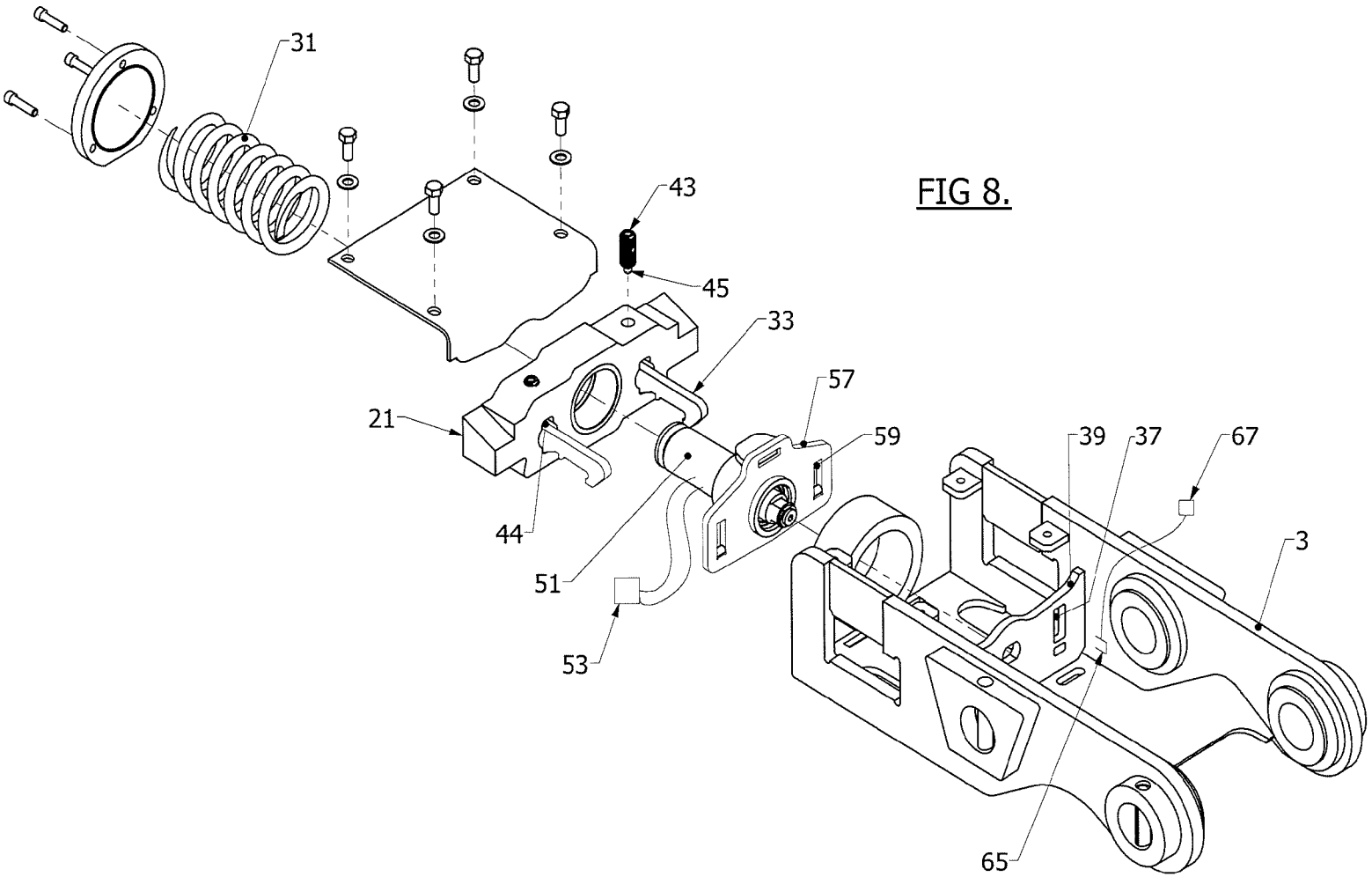
FIG. 8 is a perspective exploded view of the latching and wedge positioning mechanism of FIG. 6.

A wedge 21 is mounted on the coupler member 3 and movable, when the coupler member 3 and mounting bracket 11 are engaged, from a closed position as illustrated in FIG. 5 where the wedge 21 is engaged in a groove 23 on the mounting bracket and where a tapered side 25 of the wedge bears against a corresponding tapered side 27 of the groove to draw the coupler member 3 into engagement with the mounting bracket 11, to an open position as illustrated in FIG. 4 where the wedge 21 is removed from the groove 23.

The wedge 21 moves in an opening direction OD when moving from the closed position to the open position, and moves in a closing direction CD when moving from the open position to the closed position as illustrated in FIG. 4.

The inner mechanism of the compact quick coupling apparatus 1 is illustrated in FIGS. 6-12. A wedge bias element, provided in the illustrated embodiment by a coil spring 31 extends in the opening direction OD from the wedge 21. The coil spring 31 is operative to continuously exert a wedge bias force BF on the wedge 21 in the closing direction CD to push the wedge 21 into the groove. The coil spring 31 is also operative to continue to exert the wedge bias force BF on the wedge 21 when the wedge 21 is in the closed position such that the wedge bias force BF maintains the wedge 21 in the closed position.

A safety latch is provided and a latch bias element is operative to exert a latch bias force urging the safety latch to a latched position. The safety latch is configured such that when the wedge 21 moves into the groove 23 and reaches the closed position, the safety latch can move from an unlatched position to the latched position to prevent the wedge from moving positioning the opening direction OD to prevent accidental disengagement of the coupler member 3 from the mounting bracket 11.

Figure 12:
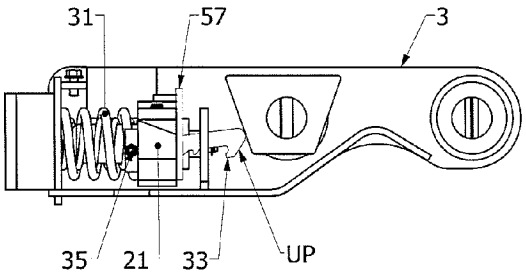
Figure 10:
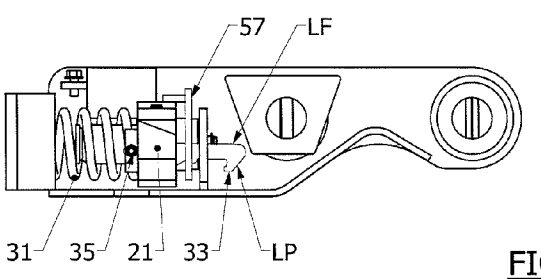
Figure 13:
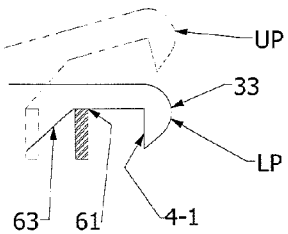
FIG. 13 is a schematic side view of the edge of the release aperture moving along the sloped portion of the latch arm to raise the latch arm from the lowered latched to the raised unlatched position.

In the illustrated embodiment, the safety latch comprises a pair of latch arms 33 extending in the closing direction CD from the wedge 21 and pivotally attached at first ends thereof to the wedge 21. The illustrated latch arms extend through holes in the wedge 21 and are connected to the wedge by pivot pins 35 such that the latch arms 33 can move from a lowered latched position LP as seen in FIGS. 10 and 13 to a raised unlatched position UP as seen in FIGS. 12 and 13.

The opposite second ends of the latch arms are configured to engage a latch aperture 37 defined by the a coupler member 3 when in the latched position LP. In the illustrated embodiment a latch aperture plate 39 is attached to the coupler member 3 and defines the latch aperture 37. The latch arms 33 are configured with hooks 41 at the ends so that when the latch arms 33 are in the lowered latched position LP, the hooks 41 will catch on the corresponding lower edges of the latch apertures 37.

A latch bias element is operative to exert a latch bias force LF on the latch arms 33 towards the lowered latched position LP. In the illustrated embodiment the latch bias element is provided by spring plungers 43 which screw down into threaded holes in the wedge 21 above the holes 44 through which the latch arms 33 extend through the wedge 21. The spring plungers 43 include a housing and a spring biased plunger 45 extending from the bottom of the housing that can move up and down against a spring located inside the housing and which thus exerts the downward latch bias force LF on the latch arms. Thus the latch bias force LF is compactly provided by having the latch arms 33 pass through the wedge 21 so that the spring plungers 43 can be mounted in the wedge 21 itself instead of in a separate mechanism, which would require more space.

Figure 11:
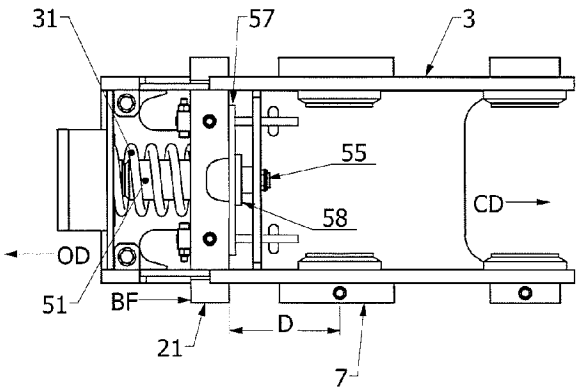
FIGS. 11 and 12 are top and side views respectively of the latching and wedge positioning mechanism of FIG. 6 with the single acting hydraulic cylinder in a partially extended position where the latch arms have been raised to the unlatched position, and the latch release plate is just beginning to bear against the wedge.

A single acting hydraulic cylinder 51 extends through the wedge 21 and extends in the opening direction OD from the wedge 21. Thus both the single acting hydraulic cylinder 51 and the coil spring 31 biasing the wedge 21 in the closing direction are located toward the opening direction relative to the wedge 21, and so are on what is essentially the outside or open side of the mechanism. As shown in FIG. 11 the distance D from the wedge 21 when in the closed position to the second pin aperture 7 is reduced compared to the prior art where the hydraulic cylinder and/or biasing springs extend toward the closing direction from the wedge 21. In addition in the illustrated embodiment where the wedge bias element is provided by a coil spring 31, the single acting hydraulic cylinder can, as illustrated, extend in the opening direction OD from the wedge 21 inside the coil spring 31, again a very compact configuration.

The single acting hydraulic cylinder 51 is configured such that when pressurized fluid is directed into the hydraulic cylinder 51, the hydraulic cylinder 51 extends and the hydraulic cylinder 51 first contacts the safety latch and exerts a force moving the safety latch to the unlatched position, and when the safety latch is in the unlatched position, further extension of the hydraulic cylinder 51 causes the hydraulic cylinder 51 to exert a force on the wedge 21 in the opening direction OD substantially opposite to the wedge bias force BF to move the wedge 21 toward the open position.

The single acting hydraulic cylinder 51 is also configured such that when pressurized fluid is released from the hydraulic cylinder 51, the hydraulic cylinder 51 retracts and the wedge 21 moves in the closing direction CD and into the groove in response to the wedge bias force BF until the wedge 21 reaches the closed position. At that point the hydraulic cylinder 51 further retracts in response to the latch bias force LF and the safety latch moves to the latched position. A remotely operated control 53, typically located near the operator's position, is operative to selectively direct pressurized fluid into the hydraulic cylinder 51 and release pressurized fluid from the hydraulic cylinder 51.

In the illustrated embodiment, a latch aperture plate 39 is attached to the coupler member 3 and defines the latch aperture 37. The piston end 55 of the single acting hydraulic cylinder 51 is attached to the latch aperture plate 39.

A latch release plate 57 is attached to a barrel 58 of the single acting hydraulic cylinder 51 between the wedge 21 and the latch aperture 37 in the latch aperture plate 39. The latch release plate 57 is configured such that the latch arms 33 extend through release apertures 59 in the latch release plate 57. As the single acting hydraulic cylinder 51 begins to extend from the fully retracted position where the latch arms 33 are in the latched position LP as shown in FIG. 9, an edge 61 of the release aperture 59 bears against sloping portions 63 of the latch arms 33 and moves the latch arms 33 up as schematically illustrated in FIG. 13.

Figure 9:
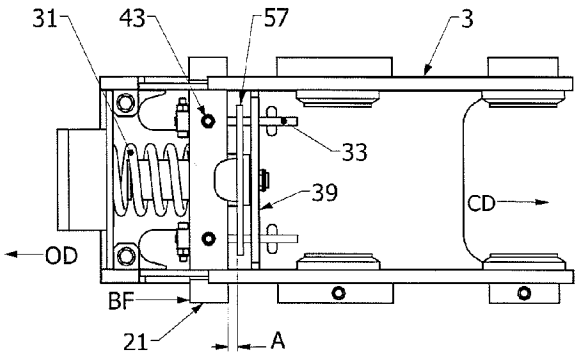
FIGS. 9 and 10 are top and side views respectively of the latching and wedge positioning mechanism of FIG. 6 with the single acting hydraulic cylinder in the fully retracted position and the latch arms in the latched position.

When the single acting hydraulic cylinder 51 has extended the distance A, as shown in FIG. 9, to the position of FIG. 11, the latch arms 33 have been raised from the latched position LP to the unlatched position UP. At that position the latch release plate 57 bears against the wedge 21 and as the single acting hydraulic cylinder 51 extends further to the fully extended position shown in FIG. 7, the wedge 21 moves in the opening direction 21 to the open position shown in FIG. 4.

A sensor 65 connected to an indicator 67 is operative to sense that the safety latch is in the latched position, and indicate same to an operator.

The apparatus of the invention thus provides a compact quick coupling apparatus for coupling a tool to a tool arm of a tool manipulating machine, and is particularly well suited for use with mini excavators and like smaller machines.

When it is desired to release the tool from the tool arm, the remote control is used to move the safety latch to an unlatched position, and the wedge positioning mechanism is operated to move the wedge to the open position.

Further with the coupler apparatus of the present invention, a first tool can be disengaged and a second tool engaged by an operator without leaving the operator station.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

The invention claimed is:

1. A compact quick coupling apparatus for coupling a tool to a tool arm of a tool manipulating machine, the apparatus comprising:

a coupler member adapted to be attached to the tool arm, and configured to engage a mounting bracket extending out from the tool;

a wedge mounted on the coupler member and movable, when the coupler member and mounting bracket are engaged, from a closed position where the wedge is engaged in a groove on the mounting bracket and where a tapered side of the wedge bears against a corresponding tapered side of the groove to draw the coupler member into engagement with the mounting bracket, to an open position where the wedge is removed from the groove;

wherein the wedge moves in an opening direction when moving from the closed position to the open position, and moves in a closing direction when moving from the open position to the closed position;

a wedge bias element extending in the opening direction from the wedge, the wedge bias element operative to continuously exert a wedge bias force on the wedge in the closing direction to push the wedge into the groove, and operative to exert the wedge bias force on the wedge when the wedge is in the closed position such that the wedge bias force maintains the wedge in the closed position;

a safety latch, and a latch bias element operative to exert a latch bias force urging the safety latch to a latched position, the safety latch configured such that when the wedge moves into the groove and reaches the closed position, the safety latch can move from an unlatched position to the latched position to prevent the wedge from moving positioning the opening direction;

a single acting hydraulic cylinder extending through an aperture in the wedge and extending in the opening direction from the wedge, the hydraulic cylinder configured such that when pressurized fluid is directed into the hydraulic cylinder, the hydraulic cylinder extends and the hydraulic cylinder moves through the aperture in the wedge and first contacts the safety latch and exerts a force moving the safety latch to the unlatched position, and when the safety latch is in the unlatched position, further extension of the hydraulic cylinder causes the hydraulic cylinder to exert a force on the wedge in the opening direction substantially opposite to the wedge bias force to move the wedge along the hydraulic cylinder toward the open position;

wherein the wedge bias element comprises a coil spring extending in the opening direction from the wedge and wherein the single acting hydraulic cylinder extends in the opening direction from the wedge inside the coil spring;

the single acting hydraulic cylinder configured such that when pressurized fluid is released from the hydraulic cylinder, the hydraulic cylinder retracts and the wedge moves in the closing direction and into the groove in response to the wedge bias force until the wedge reaches the closed position, and then the hydraulic cylinder further retracts in response to the latch bias force and the safety latch moves to the latched position; and a remotely operated control operative to selectively direct pressurized fluid into the hydraulic cylinder and release pressurized fluid from the hydraulic cylinder.

2. The apparatus of claim 1 wherein the safety latch comprises:

a latch arm extending in the closing direction from the wedge and pivotally attached at a first end thereof to the wedge such that the latch arm can move from a latched position to an unlatched position;

wherein a second end of the latch arm is configured to engage a latch aperture defined by a the coupler member when in the latched position;

wherein the latch bias element is operative to exert the latch bias force on the latch arm towards the latched position.

3. The apparatus of claim 2 comprising an indicator operative to indicate to an operator that the safety latch is in the latched position.

4. The apparatus of claim 2 comprising a latch release plate connected to the single acting hydraulic cylinder between the wedge and the latch aperture and configured such that the latch arm extends through a release aperture in the latch release plate, and wherein as the single acting hydraulic cylinder extends an edge of the release aperture bears against a sloping portion of the latch arm and moves the latch arm to the unlatched position.

5. The apparatus of claim 4 comprising an indicator operative to indicate to an operator that the safety latch is in the latched position.

6. The apparatus of claim 4 comprising a latch aperture plate attached to the coupler member and defining the latch aperture, and wherein a piston end of the single acting hydraulic cylinder is attached to the latch aperture plate.

7. The apparatus of claim 6 comprising an indicator operative to indicate to an operator that the safety latch is in the latched position.

8. The apparatus of claim 6 wherein the latch release plate is attached to a barrel of the single acting hydraulic cylinder and wherein the latch release plate bears against the wedge to move the wedge in the opening direction when the single acting hydraulic cylinder extends after the latch.

9. The apparatus of claim 8 comprising an indicator operative to indicate to an operator that the safety latch is in the latched position.

10. The apparatus of claim 1 comprising an indicator operative to indicate to an operator that the safety latch is in the latched position.

* * * * *